United States Patent [19]

Steffen

[11] 4,020,565

[45] May 3, 1977

[54] DRAFT INDUCING ROOF FOR STORAGE STRUCTURES

[76] Inventor: Sylvester L. Steffen, R.R. 3, New Hampton, Iowa 50695

[22] Filed: Oct. 28, 1975

[21] Appl. No.: 625,953

[52] U.S. Cl. ..... 34/93; 52/72; 34/233; 98/55; 98/72

[51] Int. Cl.[2] ..... F26B 19/00

[58] Field of Search ..... 98/52, 53, 54, 55, 66 R, 98/66 A, 69, 72; 34/93, 233, 168, 201, 218, 232; 126/270; 52/65, 72, 200

[56] References Cited

UNITED STATES PATENTS

| | | | |
|---|---|---|---|
| 1,362,216 | 12/1920 | Barnard et al. | 34/93 |
| 1,965,171 | 7/1934 | Boyer | 98/72 |
| 2,782,705 | 2/1957 | Breidert | 98/55 |

FOREIGN PATENTS OR APPLICATIONS

| | | | |
|---|---|---|---|
| 377,940 | 6/1923 | Germany | 34/233 |

*Primary Examiner*—Kenneth W. Sprague
*Assistant Examiner*—James C. Yeung
*Attorney, Agent, or Firm*—Henderson, Strom & Sturm

[57] ABSTRACT

A grain bin of a type having side walls and a perforated floor therein. A drying fan is connected to the bin below the perforated floor and a roof is rotatably attached to the grain bin. The roof has vanes thereon for catching wind and causing circulation of air through the bin, thereby causing ventilation of the bin. Means for rotating the roof when the wind is not blowing is also provided.

12 Claims, 6 Drawing Figures

DRAFT INDUCING ROOF FOR STORAGE STRUCTURES

BACKGROUND OF THE INVENTION

The present invention relates generally to storage structures, and more particularly to a draft-inducing roof for storage structures.

With dwindling energy resources, the necessity of harnessing freely available energy resources such as wind and sun is becoming more apparent day by day. Civilizations have come to be because of man's ability to cultivate and produce food-grains. Consequently, their curing and preservation is also a free gift of nature provided that man does not create hostile environments that cause food-grains to spoil. With the advent of heated air curing of grains, this is precisely what has been done.

Ventilation of uncured, field harvested grain requires greater ventilation to remove moisture which has been eliminated from the seed and is present in the interstitial air during the ripening process, as well as moisture and the heat of the respiration as has been taught in U.S. Pat. No. 3,408,747 and copending patent application, Ser. No. 422,760 both to Steffen.

Heretofore all ventilation of field-harvested grain in storage bins has been by means of electrically powered fans. In the open air and in the ear corn crib structures, the natural draft of atmospheric winds provides ventilation and the removal of moisture from the grain. Previously, it has not been possible to utilize naturally occurring atmospheric winds in the newer type of storage structures having solid side walls. These man-made environments have been developed primarily for storing loose grains and for storing corn which has been shelled.

Ventilation of ripe, stored grain is necessary in order to remove moisture and the heat of respiration. It would be desirable to be able to harness the freely available natural resources such as the atmospheric wind for inducing air drafts through the stored grain to provide for natural ventilation from prevailing winds. In Kansas, for example, average annual wind velocities are 15 m.p.h.

SUMMARY OF THE INVENTION

The present invention teaches natural curing of seed grains in made-made environments and the utilization of freely available resources. Specifically, this invention relates to a roof design for storage bins which is rotatably mounted to the bin and is rotatable by prevailing winds to provide ventilation to the grain stored therein, or alternatively, may be electrically rotated when sufficient wind does not prevail.

An object of the present invention is to provide a means of ventilation of a grain storage bin.

Another object of the invention is to provide ventilation to a grain bin by utilizing natural wind currents whenever possible.

A further object of the invention is to provide a back-up system for ventilating a bin when atmospheric wind currents are not blowing.

Still another object of the invention is to ventilate grain by using a minimum amount of energy from man-made resources.

Other objects, advantages and novel features of the present invention will become apparent from the following detailed description of the invention when considered in conjunction with the accompanying drawings.

DESCRIPTION OF THE PREFERRED EMBODIMENT

Figure 1:
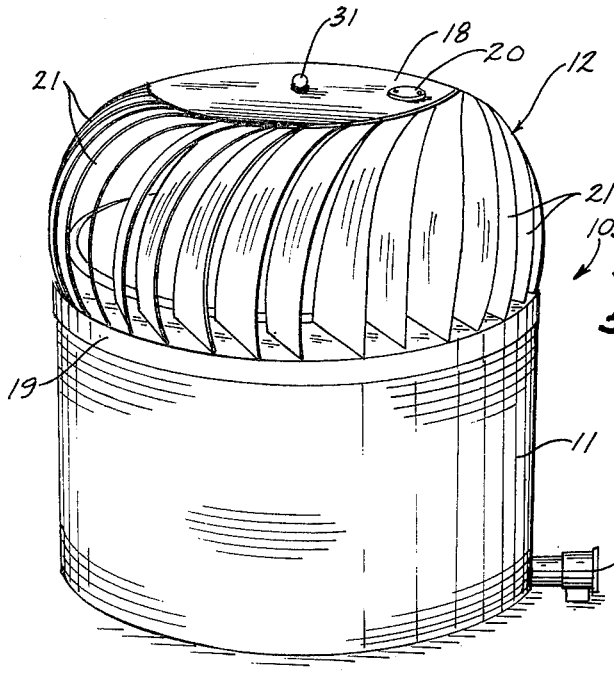
FIG. 1 is a perspective view of grain bin having the novel roof of the present invention thereon.
Figure 3:
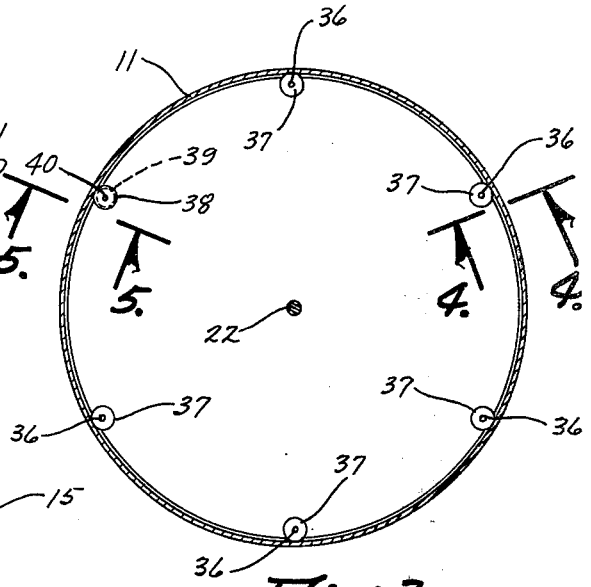
FIG. 3 is a cross-sectional view taken along line 3—3 of FIG. 2.

Referring now to the drawings wherein like reference numerals designate identical or corresponding parts throughout the several views, FIG. 1 shows a grain storage structure 10 constructed according to the present invention. The grain storage structure 10 includes side walls 11 and a roof 12 which is rotatably mounted to the remainder of the bin.

Figure 2:
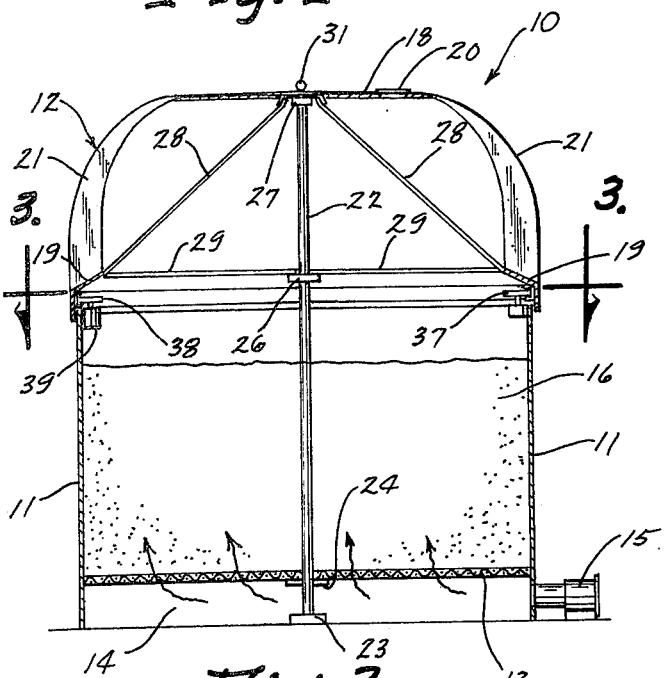
FIG. 2 is a cross-sectional view of the grain bin of FIG. 1.

Referring to FIG. 2, a perforated floor 13 is shown mounted to the side walls 11 at a distance above the bottom of the side walls 11 to form a plenum chamber 14 below the perforated floor 13. An electrically operated fan 15 is connected directly to the side walls 11 in direct communication with the plenum chamber 14 for the purpose of circulating air up through the grain 16 as indicated by the arrows 17.

The roof 12 includes a top plate 18 and a bottom annular ring 19 having a plurality of vanes 21 connected therebetween around the entire periphery of the roof 12. A central shaft 22 is mounted at the bottom end thereof by a mounting bracket 23. It is to be understood that the shaft 22 can rotate with the roof 12 or it can remain stationary and have the roof 12 rotate about it. A support bracket 24 also attached to the shaft 22 provides a central support to the perforated floor 13. Brackets 26 and 27 connected to the shaft 22 serve to rotatably mount the roof 12 to the bin 10. Braces from the bottom center of the plate 18 to the inner periphery of the bottom annular member 19. Braces 29 extend from the inner periphery of the annular member 19 to a point centrally thereof where they are connected and resting on the support member 26. A top fastener member 31 is preferably threaded into the top of the member 27 or the shaft 22 to hold the roof 12 in place but yet allow it to rotate between the fastener member 31 and the bracket member 27.

A plate 20 is removably attached to the top plate 18 for the purpose of selectively providing an opening for adding grain to the bin 10. A brake (not shown), preferably in the form of a mechanism for selectively preventing rotation of one or more of the circular members 37 is provided to stop rotation of the roof 12 when it is desired to add grain to the bin 10 through the opening covered by the plate 20.

The top plate 18 is preferably made of a transparent material such as Plexiglass for the purpose of allowing the infrared rays of the sun to enter the top of the bin 10 for sanitizing purposes to prevent the growth of mold and bacteria which would otherwise tend to grow in this environment. This arrangement also has a sanitizing effect on the air which might be entering the top of the bin during the few daylight times when the wind is not blowing enough to turn the roof 12.

Figure 4:
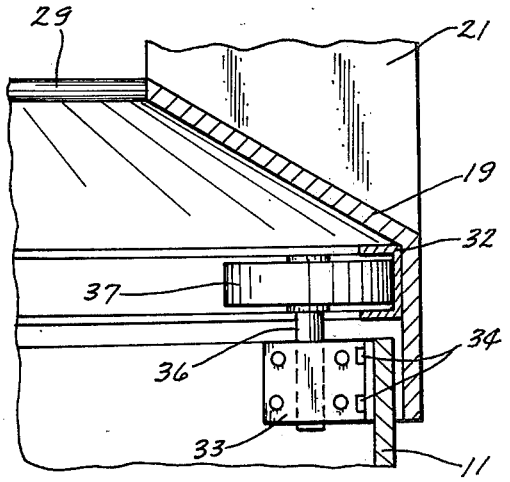
FIG. 4 is an enlarged partial cross-sectional view taken along line 4—4 of FIG. 3.

A continuous curved track or guide 32 is rigidly affixed to the circular member 19 as can clearly be seen in FIGS. 2–5. Referring to FIG. 4 in particular, it can be seen that a plurality of brackets 33 are rigidly connected to the side wall 11 by the use of a plurality of fasteners 34. Preferably, bearings are disposed within the brackets 33 and within the bearings (not shown) if bearings are to be used. Attached to the shaft 36 is a circular member 37 which is rigidly attached to the shaft, if the shaft is to rotate within the bracket 33, or alternatively, the circular member 37 can be rotatably mounted to the shaft 36 and the shaft 36 is then rigidly attached to the bracket member 33. In any event, the circular member 37 is rotatably mounted with respect to the bin walls 11 and it rides within the track 32 and is in frictional engagement with the inner periphery of the circular track 32 to thereby hold the bottom portion of the roof 12 in its proper place and prevent it from being cocked to one side or from rubbing against the bin walls 11.

Figure 5:
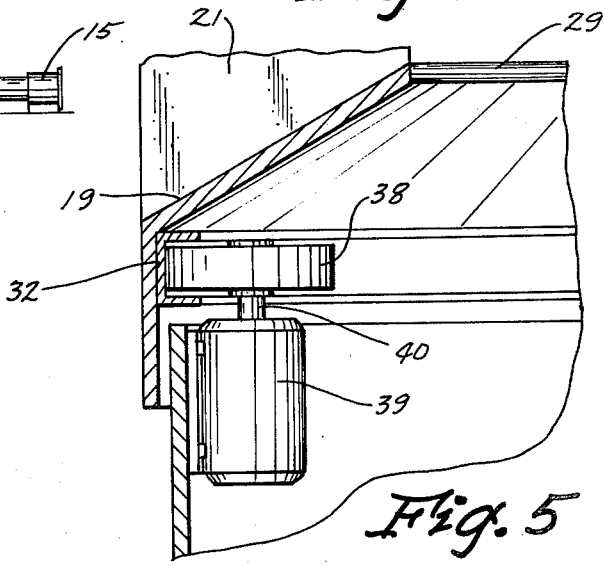
FIG. 5 is an enlarged, partial, cross-sectional view taken along line 5—5 of FIG. 3.

Referring to FIG. 5, a circular member 38 is shown. This circular member 38 is virtually indentical to the circular member 37 except that it is connected to an electric motor 39 by means of an intermediate shaft 40. This circular member 38 is also in frictional engagement with the circular track 32 so that when the motor 39 is activated, the resulting rotation of the circular member 38 will rotate the entire roof 12. If desired, a clutch can be disposed in the coupling between the motor 39 and the circular member 38 which will allow the circular member 38 to rotate when the motor 39 is not running, without rotating the entire armature of the motor 39. If desired, however, the motor 39 could be turning, thereby working as a generator when the wind is blowing and then this energy could be stored and used to run device 39 as a motor at most times when the wind is not blowing; also, the electrical energy being produced might be used to power dehumidification means in the plenum such as infrared lamps, as described in copending patent application Ser. No. 422,760, to improve the drying ability of the air. Separate generators and motors could also be provided, the motors to turn the roof when the wind is not blowing and generators connected to the roof for generating power from the rotation of the roof by the wind.

Figure 6:
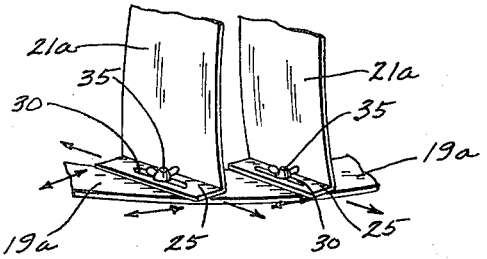
FIG. 6 is a partial perspective view of an alternate embodiment of the invention.

FIG. 6 shows an alternate embodiment of the invention having vanes 21*a* which have a variable pitch. Each of the vanes 21*a* has a flange 25 having a slot 30 therein. The flanges 25 are connected to a flat bottom annular ring 19*a* by bolt and wing nut structures 35 which pass through holes or slots (not shown) in the annular ring 19*a*, and through the slots 30. When the bolt and wing nut structures 35 are loosened, then the vanes 21*a* can be adjusted in the direction shown in FIG. 6 to vary the pitch of each vane and the opening space between vanes. Once the vanes are adjusted the wing nuts are tightened down again. Such adjustment feature can be used to close the openings somewhat to reduce the risk of snow and rain from getting in the bin during adverse weather conditions and can be used to reduce the amount of draft through the grain once it is brought to a cured condition. When lower wind velocities prevail, adjustments can be made for maximizing the use of the wind and thereby also allowing for a maximum harnessing of the wind for electrical generation purposes.

In operation, atmospheric winds would turn the entire roof structure 12 and cause corresponding air currents between the interior of the bin and the ambient atmospheric air. When these wind currents subside or are not sufficient to turn the roof 12 and cause the desired ventilation, then the motor 39 would be activated to turn the circular member 38, which by friction with the circular track 32 would then impart a rotating motion to the roof 12 to thereby provide the needed constant ventilation.

Obviously many modifications and variations of the present invention are possible in light of the above teachings. It is therefore to be understood that, within the scope of the appended claims, the invention may be practiced otherwise than as specifically described.

I claim:

1. A seed grain storage structure comprising:

a circular grain bin having side walls and a space therein for storing grain;

a circular roof, said roof including a substantially horizontally disposed fluid impervious central plate member for substantially preventing precipitation from entering the bin and a plurality of turbine-shaped vanes having openings formed therebetween in communication with said space and with ambient air, whereby rotation of said roof causes air to pass through the openings between the vanes; and means for rotatably mounting said roof to said grain bin including a plurality of circular members rotatably attached to one of the lower periphery of said roof and the upper periphery of said grain bin, and guide means attached to the other of said lower periphery of said roof and the upper periphery of said bin for guiding contact with said circular members.

2. A seed grain storage structure as defined in claim 1 wherein said vanes are arcuate in shape.

3. A seed grain storage structure as defined in claim 2 wherein a continuous row of said vanes extends completely around the outer periphery of said roof.

4. A seed grain storage structure as defined in claim 1 having means for catching wind currents to thereby rotate said roof.

5. A seed grain storage structure as defined in claim 1 having means for rotating said roof.

6. A seed grain storage structure as defined in claim 5 wherein said rotating means comprises an electric motor.

7. A seed grain storage structure as defined in claim 6 wherein said motor includes means for generating electrical power.

8. A seed grain storage structure as defined in claim 6 wherein said rotating means further comprises a circular member connected to said electric motor in frictional engagement with said roof.

9. A seed grain storage structure as defined in claim 8 including a clutch means for selectively disengaging said circular member from said motor whereby said circular member can turn when said motor is stopped.

10. A seed grain storage structure as defined in claim 1, said bin including a perforated floor and having fan means attached to said side walls below the level of said perforated floor for supplying air to grain in the bin.

11. A seed grain storage structure as defined in claim 1 including means for varying the pitch of the vanes and the distance between vanes.

12. A seed grain storage structure as defined in claim 1 wherein a portion of said roof is made of a transparent material to allow infrared rays from the sun to enter the bin.

* * * * *